US005248294A

United States Patent [19]

Cole

[11] Patent Number: 5,248,294

[45] Date of Patent: Sep. 28, 1993

[54] PHYSICAL THERAPY LEG LIFT DEVICE

[75] Inventor: Harold J. Cole, 210 Greenway Ave., Satellite Beach, Fla. 32937-3210

[73] Assignee: Harold J. Cole, Satellite Beach, Fla.

[21] Appl. No.: 918,981

[22] Filed: Jul. 23, 1992

Related U.S. Application Data

[63] Continuation-in-part of Ser. No. 744,699, Aug. 13, 1991, abandoned.

[51] Int. Cl.[5] ..... A61F 5/00

[52] U.S. Cl. ..... 602/845; 128/882; 5/648

[58] Field of Search ..... 482/142, 148; 128/25 R, 128/25 B, 26, 845, 882, 878, 879; 5/652, 653, 654, 656, 657; 602/240

[56] References Cited

U.S. PATENT DOCUMENTS

| | | | |
|---|---|---|---|
| 4,229,001 | 10/1980 | Roman | 128/25 R |
| 4,601,468 | 7/1986 | Bond et al. | 128/25 R |
| 4,848,742 | 7/1989 | Lindley et al. | 606/240 |
| 4,903,412 | 2/1990 | Pedrow | 606/240 |
| 5,060,638 | 10/1991 | Bodine, Jr. | 128/878 |

*Primary Examiner*—Robert Bahr
*Assistant Examiner*—Lynne A. Reichard

[57] ABSTRACT

A device for the physical therapy or exercise of human extremities which utilizes an elevation device and leveling mechanism.

2 Claims, 4 Drawing Sheets

PHYSICAL THERAPY LEG LIFT DEVICE

REFERENCES TO RELATED APPLICATIONS

This application is a continuation-in-part of the application with Ser. No. 07/744699 which was filed on Aug. 13, 1991 now abandoned.

BACKGROUND—FIELD OF INVENTION

This invention is for the physical therapy or strengthening of an injured or weak knee.

BACKGROUND—DESCRIPTION OF PRIOR ART

Physical therapy clinics and doctors presently use crude triangular blocks of wood which are painful or complex and expensive devices which are difficult to configure for therapy and cost prohibitive.

The use of padded triangular blocks of wood are painful because the block goes directly under the knee or back up under the thigh. The block placed under the knee or thigh doesn't always provide the desighered leg angle for therapy. When the block is placed directly under the knee the block of wood provides a very small load bearing area and pain is felt after a moderate number of repetitions.

Complex and expensive devices are also available on the market but they have disadvantages. Many devices require numerous parts and ratchet mechanisms to elevate the leg to the proper angle. The complexity of this is not the only drawback. The high cost is also a problem.

SUMMARY OF THE INVENTION

The primary use of the present invention is to provide a device which will provide low cost physical therapy of the knee.

Figure 7:
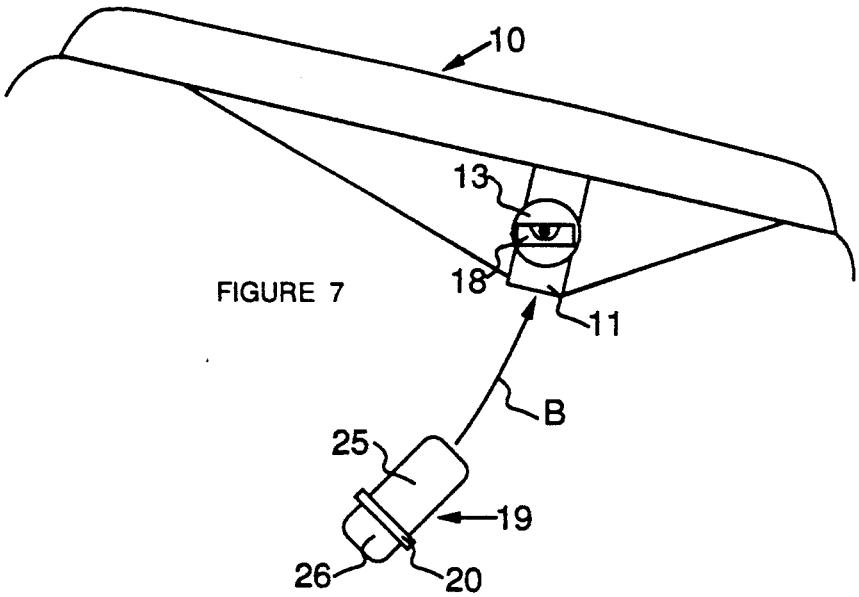
Figure 8:
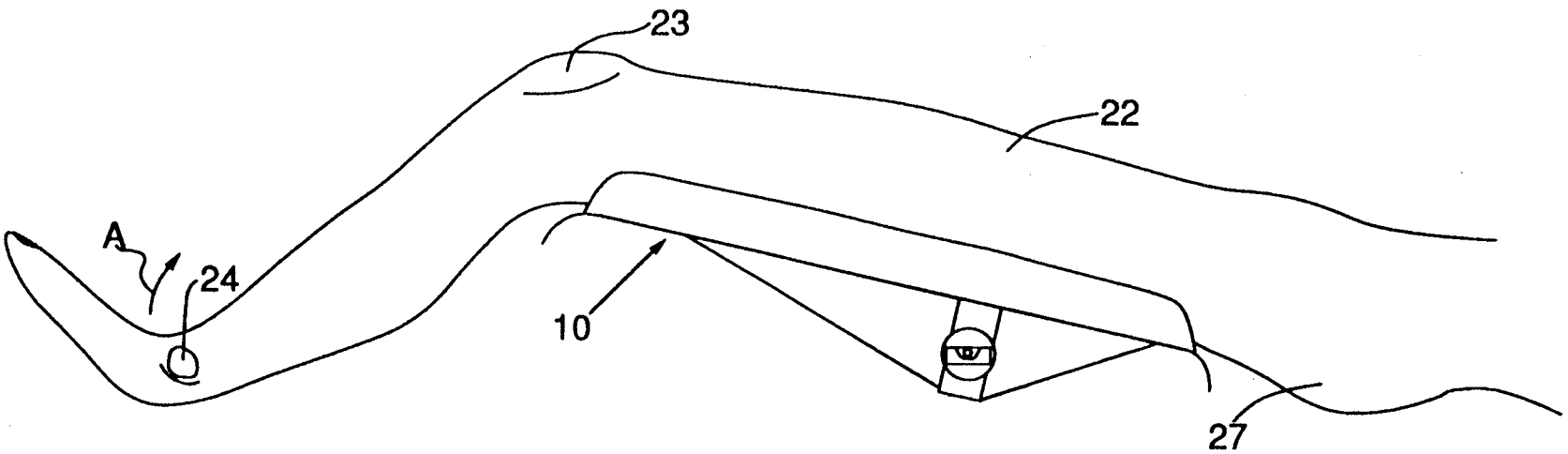

The manner for using the leg lift device is seen in FIG. 8 with a side view. The device is first placed under the leg and a reading of the sight gauge is taken to determine if the proper angle has been achieved. If the proper angle has not been achieved then the device may be moved closer to the buttocks to increase the angle or moved closer to the knee to lower the angle. In the event the proper angle still has not been achieved the elevation block (FIG. 7) must be inserted and then move the elevation device as explained earlier.

Accordingly the reader will see that the leg lift device provides a rugged, easy to clean, and easy to use device for physical therapy of the knee. The use of injected molded plastic will provide a rugged and easy to manufacture product. The plastic surface will be easy to clean with just soap and water. The sight gauge used in conjunction with the elevation block will provide a device which is easy to use. Furthermore, the leg lift device has additional advantages:

Its shape lends its self to being manufactured from almost any material such as aluminum, wood, etc.

Light weight

Although the description above contains many specifications, these should not be viewed as to limiting the scope of the device. The curved edges could be eliminated without changing the functionality of the device. The leveling bubble could be any device which would indicate the proper angle of the leg lift device. The device could even be used to exercise the arm and should by no means be limited to the knee. The elevation block doesn't have to be a block as it could be any means of providing elevation to provide proper leg angle (e.g. a ratchet device, jack, air bag, etc.).

DESCRIPTION OF DRAWING FIGURES

Figure 1:
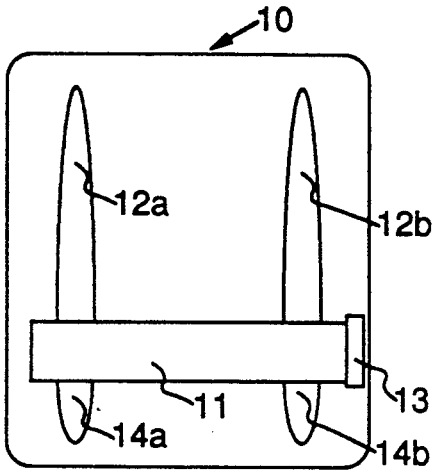

FIG. 1 the leg lift device will require a elevation block to raise the device to the proper angle. This figure depicts the bottom of the device.

Figure 2:
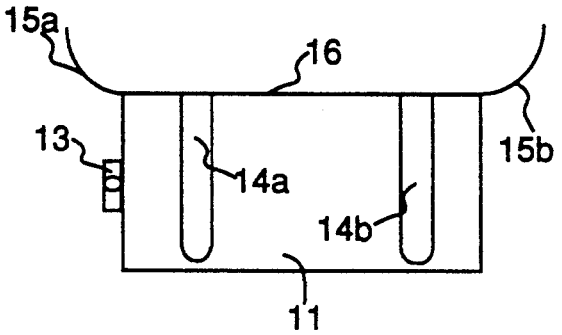

FIG. 2 the end view of the leg lift device displays the eight inch wide surface where the leg will be placed. The curved edges are in place to help keep the leg in the device. A small extension on the left side of the elevation block receptacle depicts where the sight gauge is located.

Figure 3:
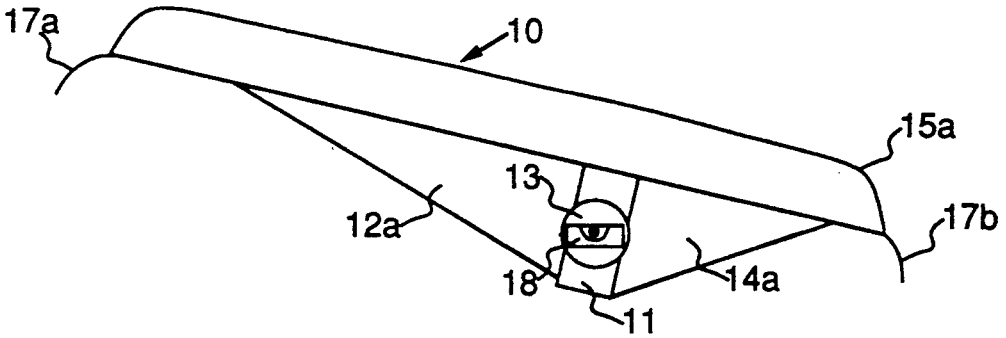

FIG. 3 the side view of the leg lift device displays the curved edges to help prevent injury when placing the leg in the device and provides rigidity to the unit. The sight gauge is displayed on the side of the elevation block receptacle which will indicate the proper angle of the leg.

Figure 4:
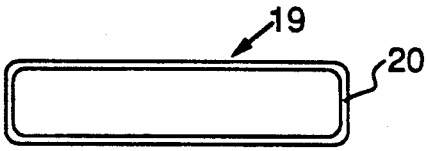

FIG. 4 this figure displays the bottom view of the elevation block.

Figure 5:
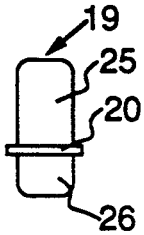

FIG. 5 this figure displays the side view of the elevation block.

Figure 6:
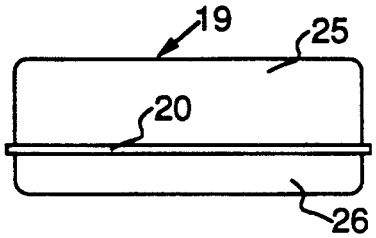

FIG. 6 this figure displays the end view of the elevation block.

FIG. 7 this figure displays the side view of the leg lift device with the elevation block being inserted. The block may be inserted in either direction to raise or lower the desired angle.

FIG. 8 this figure displays a persons leg in the leg lift device.

Figure 9:
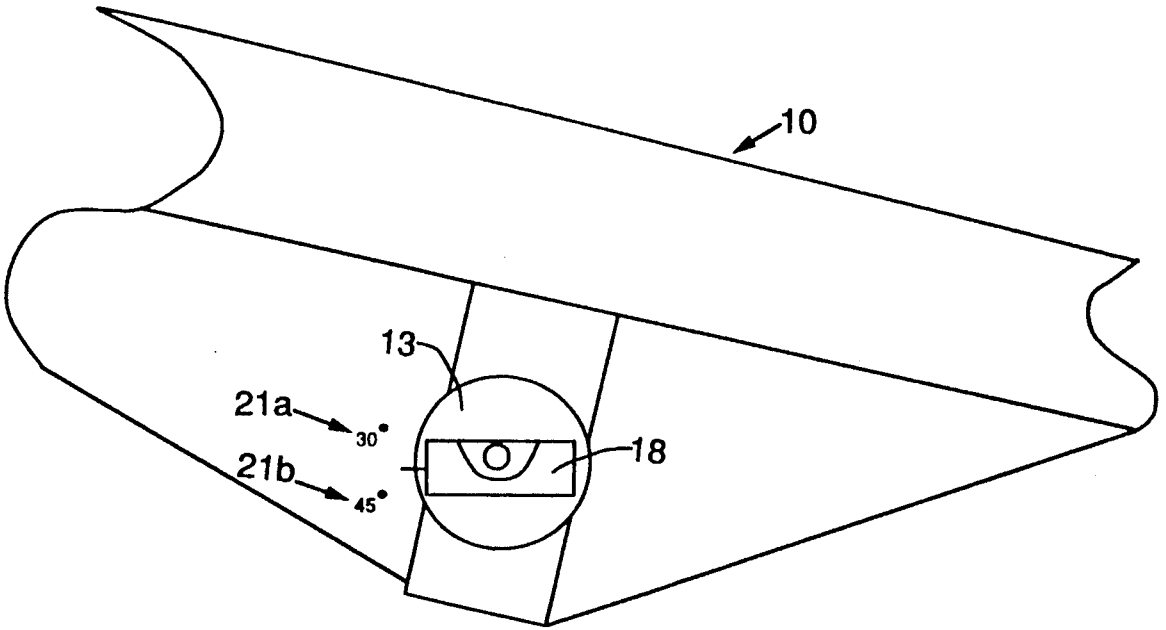

FIG. 9 this figure shows an enlarged view of the sight gauge used to adjust for the proper leg angle.

DESCRIPTION OF A PREFERRED EMBODIMENTS

The following detailed description and accompanying drawings are intended for the purposes of describing and illustrating a preferred embodiment of the present invention but should not be considered to limit the scope of the invention in any way.

The presently preferred device of the present invention comprises a flat surface with curved retaining walls and a means for elevation 10. The device 10 may be made up of any material which will allow the described uses stated hereafter. It is preferable that the material for the device 10 be of a ridged soft material for user comfort and light weight for easy transportation and use. The device 10 should be structurally sound enough to support the heaviest of body portions. The combination of comfort and light weight structural integrity can be achieved by forming the device 10 from ridged material (e.g. solid plastic, metal, wood) and a outer coating of soft material (e.g. foam rubber, cloth, plastic cushion) may be used.

A flat surface 16 and curved retaining walls 15*a* and 15*b* are formed longitudinally along the elevation axis. This is to allow the thigh 22 to be placed on the flat surface 16. The curved walls 15*a* and 16*b* help center the leg in the device. Curved portions 17*a* and 17*b* are provided to provide greater comfort under the knee 23 and buttocks 27. Thus the thigh 22 is placed on the flat surface 16 and centered by curved walls 15*a* and 15*b*.

In the first embodiment shown in FIGS. 8 and 9 is a device 18 for displaying proper thigh 22 angle. The device 18 is attached to a rotation device 13 to select a proper angle of either 30° 21*a* or 45° 21*b*. When a proper angle has been selected 21*a*, 21*b* by rotating device 13 a level indication of device 18 allows for lifting of the ankle 24 in the direction of arrow A. Ankle weights may be added for greater resistance to the direction of arrow A. The rotation device 13 may be adjusted to provide varying degrees of thigh 22 angle.

In the second embodiment shown in FIGS. 4 thru 7 a device 19 is provided to elevate device 10. Elevating device 10 with device 19 will provide proper angle of device 10 indicated on device 18. Device 19 may be inserted in one of two directions 11 to achieve proper angle of device 10. The tall portion 25 of device 19 may be inserted arrow B into receptacle 11 until the stop 20 bottoms out against edge of receptacle 11. This would provide an increase in the angle of device 10. An even greater increase in angle of device 10 can be achieved by inserting arrow B the short portion 26 of 19 into receptacle 11 until the stop 20 bottoms out against the edge of receptacle 11.

I claim:

1. An orthopedic device for supporting a user's upper or lower extremities comprising:

an extremity support means adapted to be positioned between a user's extremity and a supporting surface, said extremity support means having an upper rigid extremity engaging surface and a lower surface having an opening therein, and an elevating device, sized and configured to be inserted in said opening, said elevating device comprising a first portion having a length, a second portion having a length less than the length of said first portion, and a stop means separating said first portion from said second portion, said stop means having a thickness greater than said first and second portions such that when one of said first or second portions is inserted in said opening said greater thickness of said stop means will engage said lower surface of said extremity support means;

whereby insertion of said first portion of said elevating device in said opening elevates said upper rigid surface to a first angle with respect to a supporting surface and insertion of said second portion in said opening elevates said upper rigid surface to a second angle with respect to a supporting surface.

2. The device of claim 1, further comprising an angle indication means mounted on said extremity support means for displaying the value of the angle between said upper rigid surface and a supporting surface.

* * * * *